US009938106B2

(12) United States Patent
Miyazaki

(10) Patent No.: US 9,938,106 B2
(45) Date of Patent: Apr. 10, 2018

(54) SHEET HOUSING DEVICE AND IMAGE FORMING APPARATUS

(71) Applicant: KYOCERA Document Solutions Inc., Osaka (JP)

(72) Inventor: Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/332,021

(22) Filed: Oct. 24, 2016

(65) Prior Publication Data

US 2017/0131673 A1 May 11, 2017

(30) Foreign Application Priority Data

Nov. 9, 2015 (JP) ..... 2015-219689

(51) Int. Cl.

*B65H 31/10* (2006.01)
*G03G 15/00* (2006.01)
*B65H 31/18* (2006.01)

(52) U.S. Cl.

CPC ..... *B65H 31/10* (2013.01); *B65H 31/18* (2013.01); *G03G 15/6552* (2013.01); *B65H 2402/10* (2013.01); *B65H 2403/21* (2013.01); *B65H 2801/06* (2013.01); *G03G 2215/00818* (2013.01)

(58) Field of Classification Search

CPC .... B65H 31/10; B65H 31/12; B65H 31/3054; B65H 23/1825

See application file for complete search history.

(56) References Cited

U.S. PATENT DOCUMENTS 6,334,611 B1 1/2002 Koo
6,736,393 B2 * 5/2004 Noh ..... B65H 31/10 271/214
2004/0069594 A1 * 4/2004 Freund ..... B65H 15/02 198/377.03
2007/0035078 A1 * 2/2007 Yoshie ..... B65H 31/3009 270/58.01

FOREIGN PATENT DOCUMENTS

JP 03134351 A * 6/1991
JP 2010-173746 A 8/2010

OTHER PUBLICATIONS

An Office Action issued by the Chinese Patent Office dated Jan. 29, 2018, which corresponds to Chinese Patent Application 201610921865.0 and is related to U.S. Appl. No. 15/332,021.

* cited by examiner

*Primary Examiner* — Howard J Sanders
(74) *Attorney, Agent, or Firm* — Studebaker & Brackett PC

(57) ABSTRACT

A sheet housing device includes a supporting member, a driving pulley, a driven pulley, a timing belt, a driving part, a stacking tray and rotating members. The driving pulley and the driven pulley are rotatably provided at one end and another end in a longitudinal direction of the supporting member, respectively. The timing belt is windingly stretched between the pulleys. The driving part drives and rotates the driving pulley. The stacking tray is fixed to the timing belt and attached to the supporting member to move between both ends of the supporting member according to rotation of the timing belt. The rotating members are provided at another end side more than a rotational center of the driving pulley and at both outsides more than the timing belt and are rotatably attached by having a rotating shaft parallel to a rotating shaft of the driving pulley.

8 Claims, 9 Drawing Sheets

SHEET HOUSING DEVICE AND IMAGE FORMING APPARATUS

INCORPORATION BY REFERENCE

This application is based on and claims the benefit of priority from Japanese Patent application No. 2015-219689 filed on Nov. 9, 2015, the entire contents of which are incorporated herein by reference.

BACKGROUND

The present disclosure relates to a sheet housing device housing an ejected sheet and an image forming apparatus including this sheet housing device.

An image forming apparatus may include a post-processing device carrying out post-processes, such as punching or stapling, with respect to a sheet on which an image has been formed. The post-processing device functions as a sheet housing device stacking and housing a post-processed sheet. The sheet housing device includes a stacking tray stacking the post-processed sheet and may include an elevating mechanism to elevate the stacking tray in accordance with the sheet stacking quantity. The elevating mechanism is configured, for example, so that a timing belt is windingly stretched between a driving pulley, such as a winding pulley, and a driven pulley, the stacking tray is fixed to a part of the timing belt and the timing belt is rotated to elevate the stacking tray. In a driving mechanism for such a timing belt, there is a possibility that belt coming-off (dropping-off) or belt tooth skipping of the timing belt occurs.

For example, an image forming apparatus may include a timing belt driving device in which a tooth skipping preventing member is disposed to face to a timing pulley subjected to tooth skipping preventing. The tooth skipping preventing member is provided at a position at which a separation distance from an outside surface of the timing belt wound around the timing pulley is smaller than a height of meshing between the timing pulley and the timing belt.

However, in the timing belt driving device as mentioned above, because the separation distance between the belt tooth skipping preventing member and the outside surface of the timing belt needs to set smaller than the height of meshing between the timing pulley and the timing belt, a positional relationship of the belt tooth skipping preventing member with respect to the timing pulley is severe. In the sheet housing device (the post-processing device) of the image forming apparatus, because the timing belt elevating the stacking tray often has the height of the teeth set low as 1.9 mm, 1.1 mm or 1 mm or less, it is very difficult to precisely dispose such a belt tooth skipping preventing member.

SUMMARY

In accordance with the present disclosure, a sheet housing device includes a supporting member, a driving pulley, a driven pulley, a timing belt, a driving part, a stacking tray and rotating members. The driving pulley is rotatably provided at one end side in a longitudinal direction of the supporting member. The driven pulley is rotatably provided at another end side in the longitudinal direction of the supporting member. The timing belt is windingly stretched between the driving pulley and the driven pulley. The driving part drives and rotates the driving pulley. The stacking tray is fixed to the timing belt and attached to the supporting member so as to move between one end side and another end side of the supporting member in accordance with rotation of the timing belt. The rotating members are provided at another end side more than a rotational center of the driving pulley and at both outsides in an outer diameter direction more than an outer circumferential face of the timing belt windingly stretched on the driving pulley, and are rotatably attached by having rotating shafts parallel to a rotating shaft of the driving pulley.

In accordance with the present disclosure, an image forming apparatus includes sheet housing device as described above and an image forming part forming an image on a sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
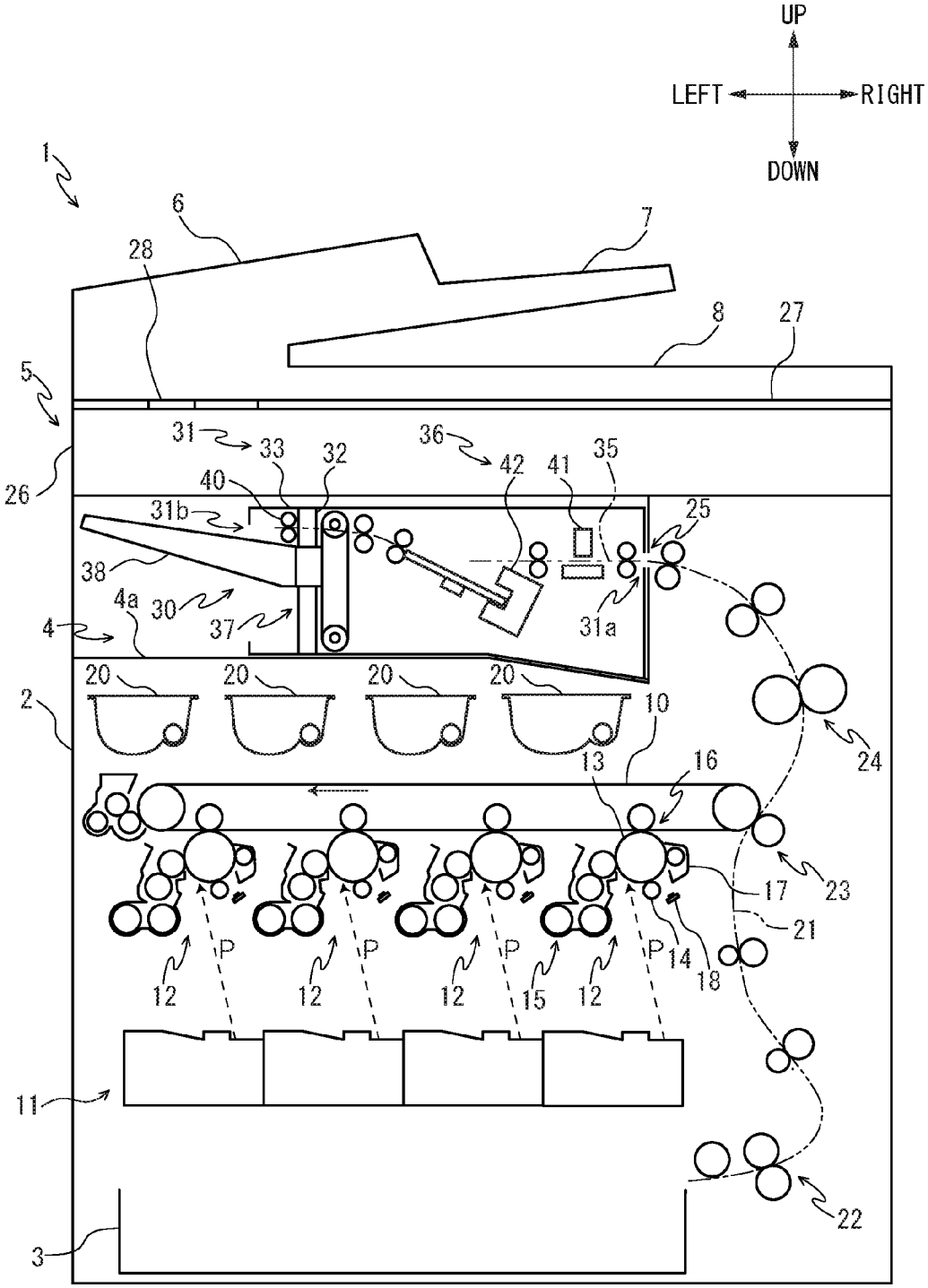
FIG. 1 is a sectional view schematically showing a multifunction peripheral according to an embodiment of the present disclosure.

First, with reference to FIG. 1, an entire configuration of a multifunction peripheral 1 as an image forming apparatus according to an embodiment of the present disclosure will be described. FIG. 1 is a sectional view showing the multifunction peripheral 1. Hereinafter, it will be described so that the front side of the multifunction peripheral is positioned at the near side on a paper sheet of FIG. 1 and it will be described with reference to directions indicated in the figures.

As shown in FIG. 1, the multifunction peripheral 1 includes a box-formed apparatus main body 2 formed. In a lower part of the apparatus main body 2, a sheet feeding cartridge 3 storing sheets (recording mediums) is provided and, in an upper part of the apparatus main body 2, an in-body space 4 is provided. Incidentally, the sheet may be a paper-made sheet, but is not limited to it and may be a resin film or the like. The in-body space 4 is a roughly parallelepiped space elongated in left and right directions in which a front face and a left face of the apparatus main body 2 are opened. A bottom face constituting the in-body space 4 is formed as a first ejected sheet tray 4*a*. The sheet feeding cartridge 3 and the first ejected sheet tray 4*a* are employed to convey the sheet on which an image is to be formed by image forming parts 12 inside the apparatus main body 2.

In the upper part of the apparatus main body 2, an image reading device 5 reading an object visually represented on a document as image data is provided at an upper side than the in-body space 4. Above the image reading device 5, a document conveying part 6, such as an auto document feeder (ADF), feeding the document to the image reading device 5 is provided. On a top face of the document conveying part 6, a sheet feeding tray 7 is provided and, below the sheet feeding tray 7, a second ejected sheet tray 8 is provided. The sheet feeding tray 7 and the second ejected sheet tray 8 are employed to convey the document on which an image is to be read by the image reading device 5.

At a central part of the apparatus main body 2, an intermediate transferring belt 10 is windingly stretched among a plurality of rollers and, below the intermediate transferring belt 10, an exposure device 11 composed of a laser scanning unit (LSU) is disposed. In the vicinity of the intermediate transferring belt 10, along a lower part of the intermediate transferring belt 10, four image forming parts 12 are provided for respective toner colors (for example, four colors of magenta, cyan, yellow and black). At each image forming part 12, a photosensitive drum 13 is rotatably provided and, around the photosensitive drum 13, a charging device 14, a development device 15, a first transferring part 16, a cleaning device 17 and a static eliminator 18 are disposed in sequential order of first transferring processes. Above the development device 15, four toner containers 20 as toner cases corresponding to the respective image forming parts 12 are provided for respective toner colors.

At one side (the right side on the figure) of the apparatus main body 2, a conveying path 21 for the sheet is provided. At an upstream end of the conveying path 21, a sheet feeding part 22 is provided. At a middle stream part of the conveying path 21, a second transferring part 23 is provided at one end of the intermediate transferring belt 10 (the right end on the figure). At a downstream part of the conveying path 21, a fixing device 24 is provided. At a downstream end of the conveying path 21, a sheet ejecting port 25 is provided. The sheet ejecting port 25 is opened on a right interior face constituting the in-body space 4.

The image reading device 5 is configured to include an image reading part 26 therein and to include a platen glass 27 and a document reading slit 28 on a top face. The image reading part 26 is configured to include an optical scanning unit (not shown) and an imaging part (not shown), such as CCD, and to read an image of the document on the platen glass 27 or the document reading slit 28.

The image conveying part 6 has a document conveying path (not shown) from the sheet feeding tray 7 to the second ejected sheet tray 8 via the top of the document reading slit 28. When the image of the document stacked on the sheet feeding tray 7 is read, the document conveying part 6 feeds the document from the sheet feeding tray 7 to the top of the document reading slit 28 along the document conveying path as described above and ejects the document from the top of the document reading slit 28 to the second ejected sheet tray 8.

Next, the operation of forming an image by the multifunction peripheral 1 having such a configuration will be described. When the power is supplied to the multifunction peripheral 1, various parameters are initialized and initial determination, such as temperature determination of the fixing device 24, is carried out. Subsequently, in the multifunction peripheral 1, when image data is inputted and a printing start is directed from the image reading device 5, an external computer (not shown) or the like, image forming operation is carried out as follows.

Firstly, the surface of the photosensitive drum 13 is electrically charged by the charging device 14. Then, an electrostatic latent image is formed on the surface of the photosensitive drum 13 by a laser light (refer to an arrow P) from the exposure device 11. The electrostatic latent image is developed to a toner image having a correspondent color in the development device 15 by the toner supplied from the toner container 20. The toner image is first-transferred onto the surface of the intermediate transferring belt 10 in the first transferring part 16. The above-mentioned operation is repeated in order by the respective image forming parts 12, thereby forming the toner image having full color onto the intermediate transferring belt 10. Incidentally, toner and electric charge remained on the photosensitive drum 13 are removed by the cleaning part 17 and the static eliminator 18.

On the other hand, the sheet taken out from the sheet feeding cartridge 3 or a manual bypass tray (not shown) by the sheet feeding part 22 is conveyed to the second transferring part 23 in a suitable timing for the above-mentioned image forming operation. Then, in the second transferring part 23, the toner image having full color on the intermediate transferring belt 10 is second-transferred onto the sheet. The sheet with the second-transferred toner image is conveyed to a downstream side on the conveying path 21 to enter the fixing device 24, and then, the toner image is fixed on the sheet in the fixing device 24. The sheet with the fixed toner image is ejected from the sheet ejecting port 25 into the in-body space 4 (onto the ejected sheet tray 4*a*).

In addition, the multifunction peripheral 1 includes a post-processing device 30 carrying out post-processes, such as punching or stapling, with respect to a sheet or a bundle of sheets on which an image has been formed. This post-processing device 20 also functions as a sheet housing device stacking and housing a post-processed sheet.

The post-processing device 30 is attachably/detachably provided in the in-body space 4 of the apparatus main body 2. The post-processing device 30 is electrically connected to a power source (not shown) or a controlling device (not shown) provided in the apparatus main body 2 to thereby enable power supply and transmission/reception of an electrical signal or the like to the post-processing device 30.

Figure 2:
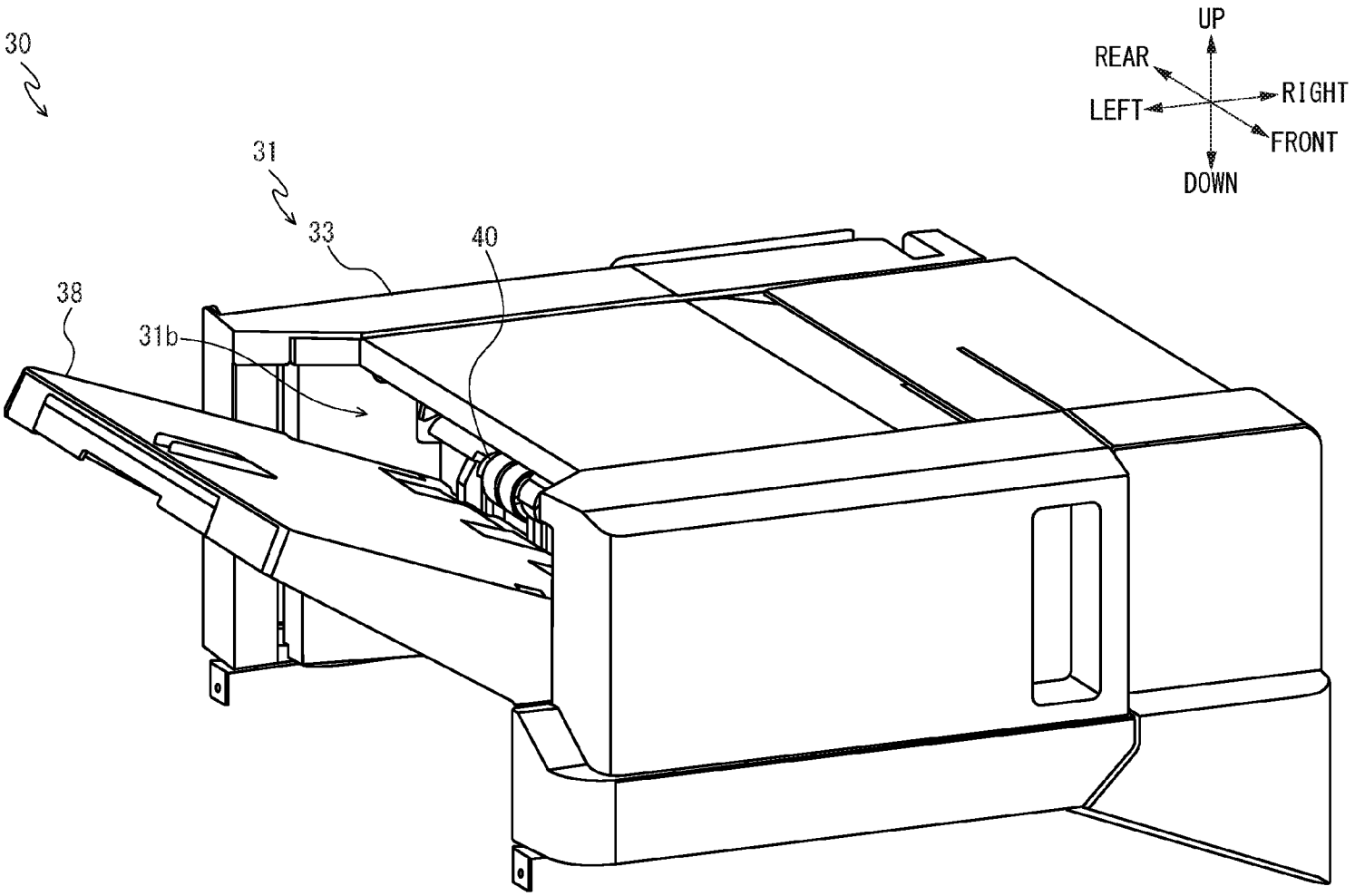
FIG. 2 is a perspective view showing a post-processing device attached in an in-body space of the multifunction peripheral according to the embodiment of the present disclosure.

As shown in FIG. 1 and FIG. 2, the post-processing device 30 includes a casing 21 formed in a roughly parallelepiped shape elongated in the left and right directions. The casing 21 is configured to cover a flame body composed of a pair of front and rear L-shaped supporting frames 32 with an exterior cover 33 (refer to FIG. 2 and FIG. 3). Each supporting frame 32 is composed of a first supporting member 32*a* (a supporting member) extending in upward and downward directions and a second supporting member 32*b* (a supporting member) extending in the right direction from a lower end of the first supporting member 32*a*. At one side (a right side) of the casing 31, a conveying inlet 31*a* (refer to FIG. 1) is opened and, at another side (a left side) of the casing 21, a conveying outlet 31*b* is opened. The conveying inlet 31*a* is provided at a corresponding position (at a same height) to the sheet ejecting port 25.

The post-processing device 30 includes a conveying path 35, a post-processing part 36 and a tray elevating mechanism 37 inside the casing 31 and includes a stacking tray 38 extending to the outside from the inside of the casing 31.

The conveying path 35 is a path arranged for conveying the sheet by a plurality of conveying rollers and is arranged from the conveying inlet 31*a* to the conveying outlet 31*b* in the left and right directions. At a downstream side in the sheet conveyance direction of the conveying path 35, an ejecting roller 40 having a rotating shaft extending in forward and backward directions is provided in the vicinity of the conveying outlet 31*b*.

The post-processing part 36 includes a punching device 41 carrying out punching process with respect to the sheet or the bundle of sheets on which an image has been formed and a stapling device 42 carrying out stapling process with respect to the sheet or the bundle of sheets on which an image has been formed. The punching device 41 is provided at an upstream side in the sheet conveyance direction of the conveying path 35 and the stapling device is provided at the downstream side more than the punching device 41 in the sheet conveying direction of the conveying path 35. Alternatively, the post-processing part 36 may be configured to include with either one of the punching device 41 and the stapling device 42 or to include a sheet folding device (not shown) center-folding the sheet or a sorting device (not shown) sorting the sheet in addition to the punching device 41 and/or the stapling device 42.

Figure 3:
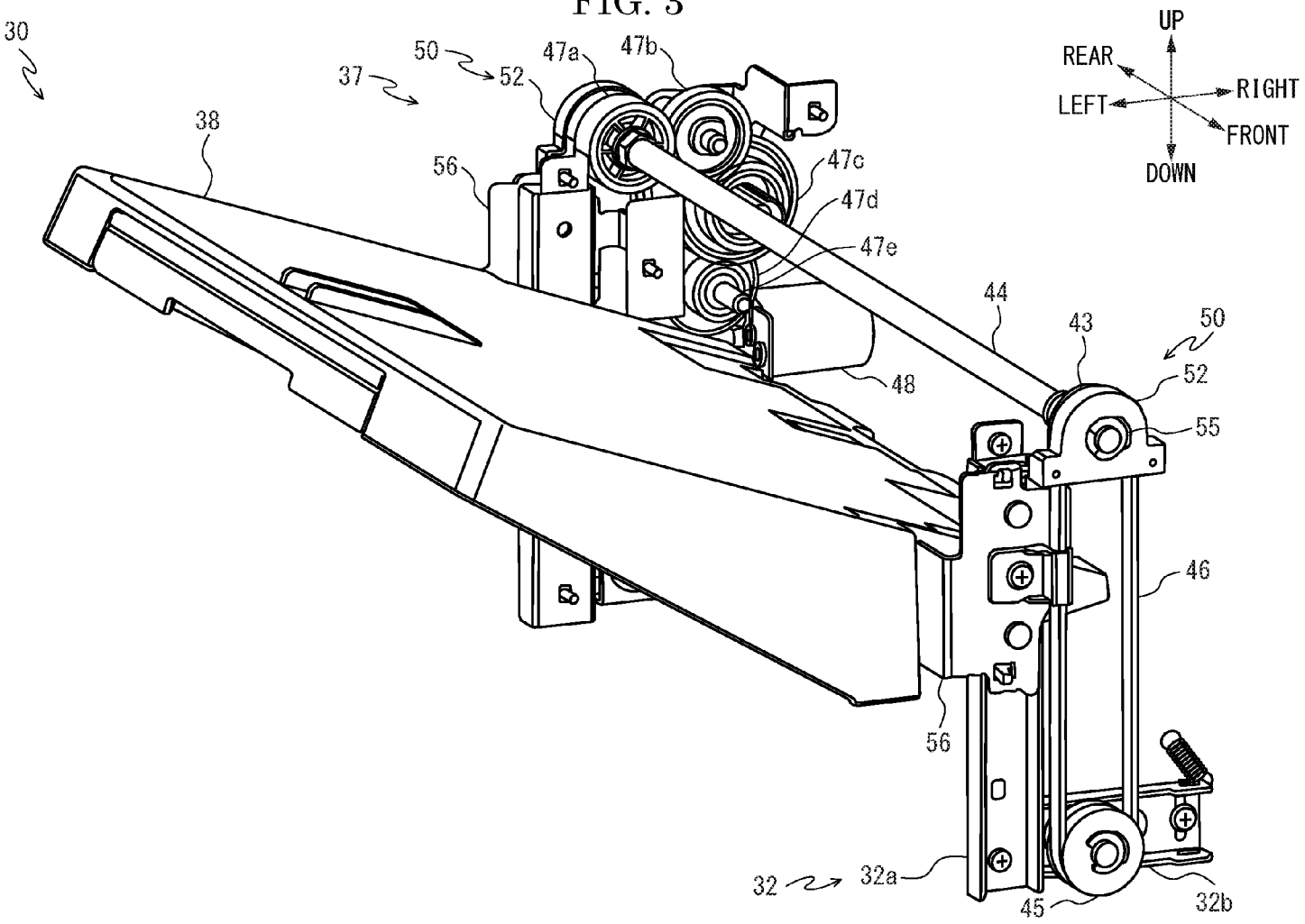
FIG. 3 is a perspective view showing a stacking tray and a tray elevating mechanism of the post-processing device according to the embodiment of the present disclosure.
Figure 4:
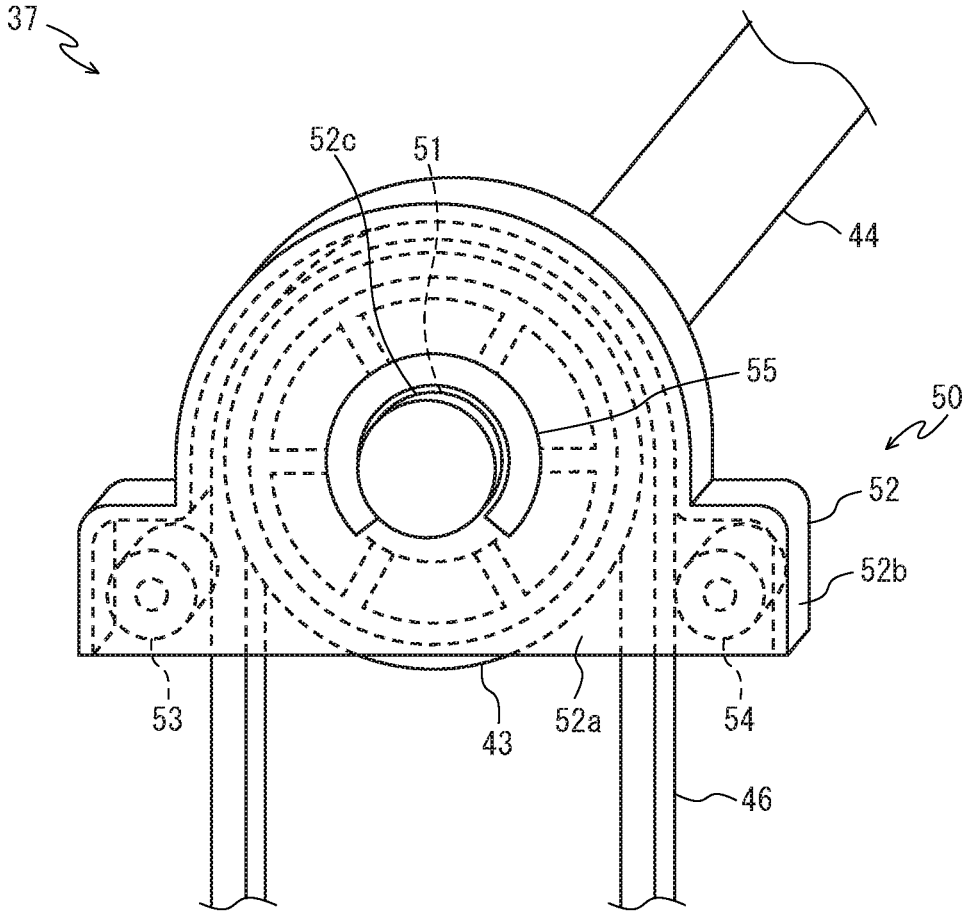
FIG. 4 is a perspective view showing an upper part of the tray elevating mechanism in the post-processing device according to the embodiment of the present disclosure.
Figure 5:
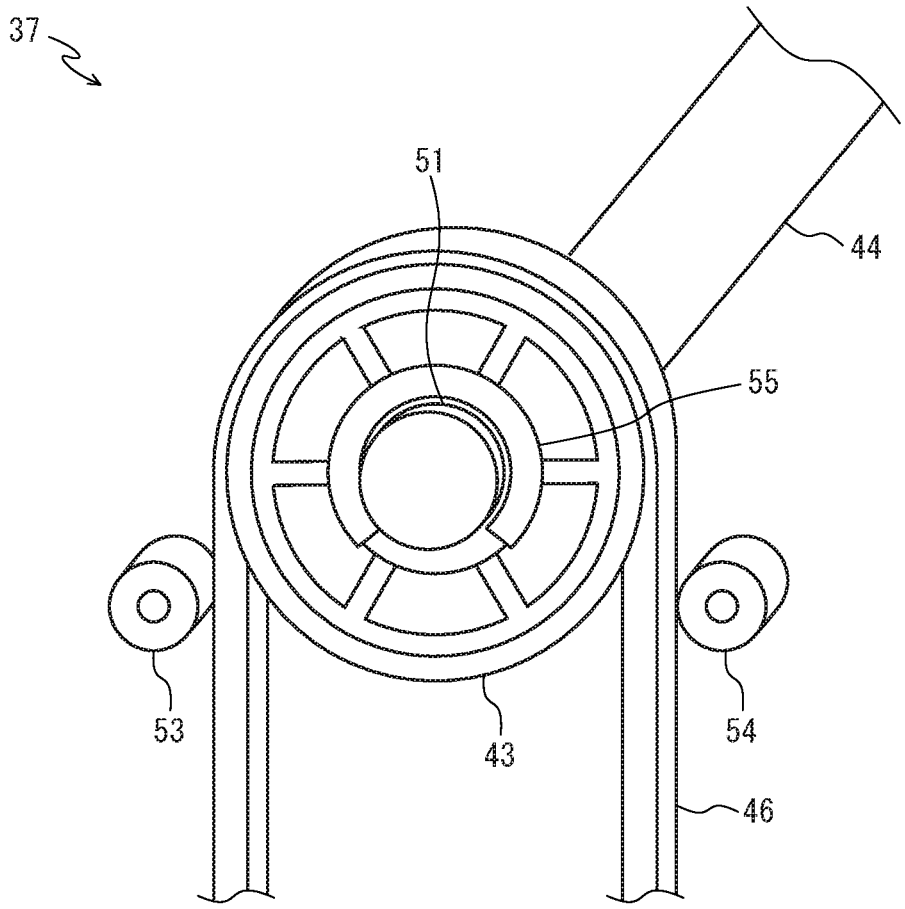
FIG. 5 is a perspective view showing the upper part of the tray elevating mechanism, in a state that a covering part of a holding member has been detached, in the post-processing device according to the embodiment of the present disclosure.

The tray elevating mechanism 37 includes, as shown in FIG. 3 to FIG. 5 and other figures, a pair of front and rear driving pulleys 43, a coupling shaft 44 (a rotating shaft of each driving pulley 43), a pair of front and rear driven pulleys 45, a pair of front and rear timing belts 46, a plurality of gears 47*a* to 47*d*, a driving part 48 and a pair of front and rear holding members 50. In the following description, an axial direction indicates an axial direction of each driving pulley, i.e., an axial direction of the coupling shaft 44, the outside in an axial direction indicates each end side in the forward and backward directions of the coupling shaft 44 and the inside in an axial direction indicates a central side in the forward and backward directions direction of the coupling shaft 44.

Each driving pulley 43 is a winding pulley winding up each timing belt 46, a plurality of teeth (not shown) are formed on an outer circumferential face thereof and a through hole 51 is formed at a center thereof. Each driving pulley 43 is rotatably attached at an upper end side (one end side) of the first supporting member 32*a* of each supporting frame 32. The coupling shaft 44 has a shape extending in the forward and backward directions. Both of the front and rear ends of the coupling shaft 44 are passed through the respective through holes 51 of the pair of front and rear driving pulleys 43 and are coaxially fixed.

In each driven pulley 45, similar to each driving pulley 43, a plurality of teeth are formed on an outer circumferential face thereof. Each driven pulley 45 is rotatably attached at a lower end side (another end side) of the first supporting member 32*a* of each supporting frame 32.

Each timing belt 46 is an endless belt having a plurality of teeth (not shown) on an inner circumferential face thereof. Each timing belt 46 is meshed with each driving pulley 43 and each driven pulley 45 and windingly stretched between each driving pulley 43 and each driven pulley 45.

The plurality of gears 47*a* to 47*d* and the driving part 48 are configured to drive the coupling shaft 44 and are provided at a rear part of the casing 31. Specifically, the plurality of gears 47*a* to 47*d* are sequentially meshed and attached between the rear driving pulley 43 and the driving part 48. The gear 47*a* closest to the rear driving pulley 43 is coaxially fixed to the coupling shaft 44 at the inside in the axial direction (a front side) more than the rear driving pulley 43 and other gears 47*b*, 47*c* and 47*d* are rotatably attached to the rear supporting frame 32. Moreover, the gear 47*d* closest to the driving part 48 includes a coaxial worm 47*e*.

The driving part 48 is composed of a motor or the like and is provided with a worm wheel (not shown) coaxial to a driving shaft transmitting a driving force. Then, if the worm 47*e* of the gear 47*d* and the worm wheel of the driving part 48 are meshed with each other, the driving force from the driving part 48 is transmitted to the plurality of gears 47*a* to 47*d* and further transmitted to the pair of front and rear driving pulleys 43 via the coupling shaft 44.

Each holding member 50 includes a covering part 52 and at least two rotating members 53 and 54 (belt tooth skipping preventing members) and is configured to cover each driving pulley 43 from the outside in the axial direction.

Figure 7:
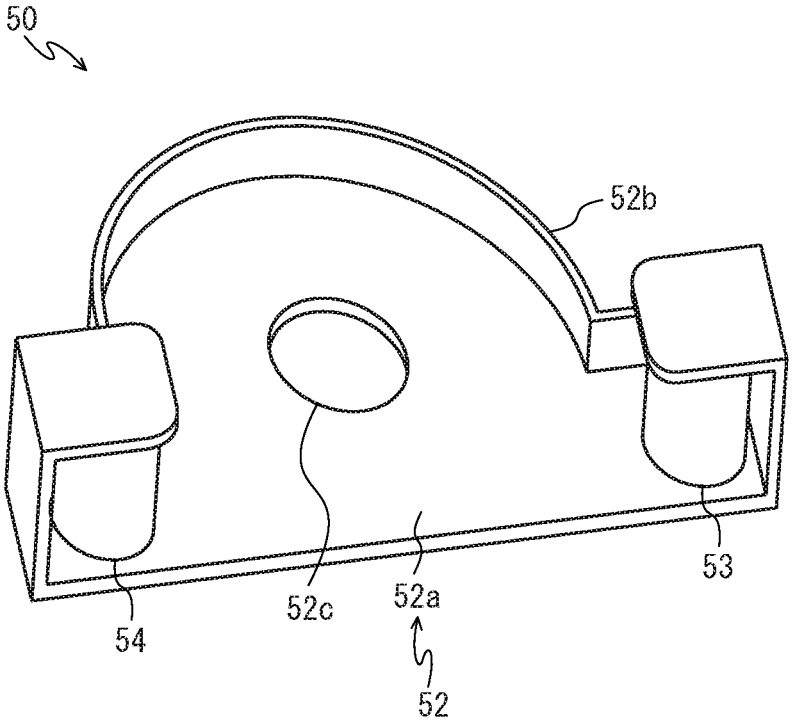
FIG. 7 is a perspective view showing the holding member as viewed from the inside in an axial direction in the tray elevating mechanism of the post-processing device according to the embodiment of the present disclosure.

The covering part 52 of each holding member 50 is formed, as shown in FIG. 4 or FIG. 7, so that a wall portion 52*a* covering the outside face in the axial direction of each driving pulley 43 and an extension portion 52*b* extending to the inside in the axial direction from an edge of the wall portion 52*a* are integrally molded with each other. Incidentally, the inside in the axial direction and a lower side of the covering part 52 are opened. An upper side of the wall portion 52*a* constituting the covering part 52 is formed in a roughly semicircular shape of which outer diameter is larger than that of the timing belt 46 windingly stretched on the driving pulley 43. A lower side of the wall portion 52*a* is formed in a rectangular shape elongated in the left and right directions more than the upper side. In this wall portion 52*a*, a bearing hole 52*c* is formed at a roughly center. Each holding member 52 is attached so as to idle with respect to the coupling shaft 44 by attaching a retaining member 55 at each end of the coupling shaft 44 passed through the bearing hole 52*c*.

Figure 6:
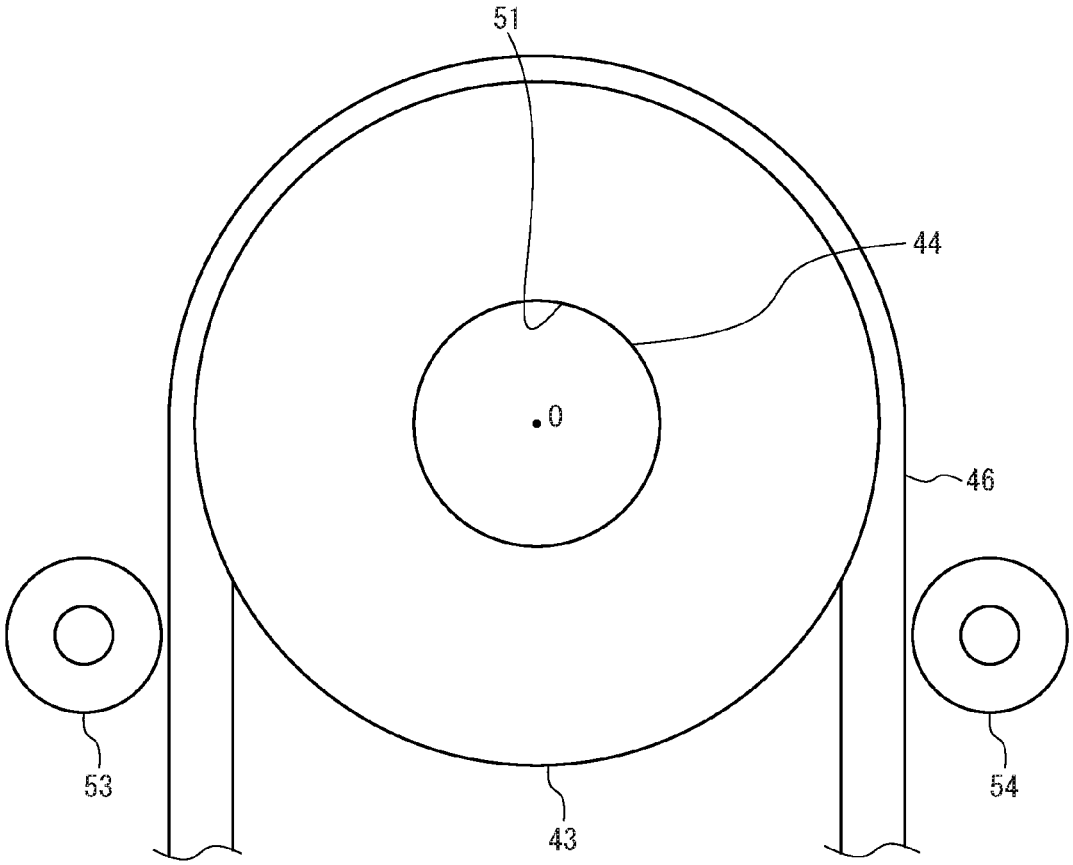
FIG. 6 is a front view showing a driving pulley and a rotating member in the tray elevating mechanism of the post-processing device according to the embodiment of the present disclosure.

The rotating members 53 and 54 are cylindrically formed rollers to have a rotating shaft parallel to the coupling shaft 44 and is rotatably attached to the inside face (an interior face) in the axial direction of the wall portion 52*a* of the covering part 52 of each holding member 50. As shown in FIG. 6, two rotating members 53 and 54 are respectively arranged at a lower end side (another end side) than a rotational center O of each driving pulley 43 and at both outsides in an outer diameter direction of each driving pulley 43 more than the outer circumferential face of the timing belt 46 windingly stretched on each driving pulley 43. Further, the rotating members 53 and 54 are respectively attached at positions which come close to or come into contact with the outer circumferential face of the timing belt 46 windingly stretched on each driving pulley 43. Incidentally, although the embodiment illustrates a configuration including the two rotating members 53 and 54, three or more rotating members 53 and 54 may be included.

The stacking tray 38 is a tray having an inclined plane extending in a left upward direction from a right lower side and includes a pair of front and rear sliding members 56. The pair of front and rear sliding members 56 are respectively fixed to the front and rear ends at a right part of the stacking tray 38. Also, each sliding member 56 is attached to the first supporting member 32*a* of each supporting frame 32 so as to be slidable along a longitudinal direction of the first supporting member 32*a*. Further, each sliding member 56 is configured so that a right end thereof is fixed to each timing belt 46 to move in accordance with rotation of each timing belt 46.

That is, the stacking tray 38 is fixed to the timing belt 46 and in accordance with rotation of the timing belt 46 is attached to the first supporting member 32*a* so as to move between the upper end side (one end side) and the lower end side (another end side) of the first supporting member 32*a*. Moreover, the stacking tray 38 is extended in the left upward direction through the conveying outlet 31*b* of the casing 31 from the supporting frame 32 inside the casing 31.

An operation of the stacking tray 38 by the tray elevating mechanism 37 having the above-described configuration will be described.

For example, in a case where the stacking tray 38 is risen, the driving part 48 drives the plurality of gears 47*a* to 47*d* and rotates the coupling shaft 44 in the clockwise direction as viewed from the front side. Then, in accordance with rotation of the coupling shaft 44, the pair of front and rear driving pulleys 43 are rotated in the clockwise direction as viewed from the front side and the pair of front and rear timing belts 46 are rotated in the clockwise direction as viewed from the front side. At this time, left side portions of the pair of front and rear timing belts 46 are moved upwardly, and accordingly, the stacking tray 38 fixed to the pair of front and rear timing belts 46 is risen.

Incidentally, in a case where the stacking tray 38 is lowered, the tray elevating mechanism 37 is operated in a similar way to the case where the stacking tray 38 is risen, whereas the driving part 48 rotates the coupling shaft 44 in the counterclockwise direction as viewed from the front side.

According to the embodiment, as described above, the post-processing device 30 as a sheet housing device includes: the first supporting member 32*a* (the supporting member) of the supporting frame 32; the driving pulley 43 rotatably provided at the upper end side (one end side in the forward and backward directions) of the first supporting member 32*a*; the driven pulley 45 rotatably provided at the lower end side (another end side in the forward and backward directions) of the first supporting member 32*a*; the timing belt 46 windingly stretched between the driving pulley 43 and the driven pulley 45; the driving part 48 driving and rotating the driving pulley 43; the stacking tray 38 fixed to the timing belt 46 and attached to the first supporting member 32*a* so as to move between the upper end side and the lower end side of the first supporting member 32*a* in accordance with rotation of the timing belt 46; and rotating members 53 and 54 provided at the lower end side than the rotational center O of the driving pulley 43 and both outsides in the outer diameter direction more than the outer circumferential face of the timing belt 46 windingly stretched on the driving pulley 43, and rotatably attached by having the rotating shafts parallel to the coupling shaft 44.

In accordance with such a configuration, in the post-processing device 30 (the sheet housing device), by a simple configuration provided with the rotating members 53 and 54 as belt tooth skipping preventing members, it is possible to prevent a belt tooth skipping from occurring between the driving pulley 43 and the timing belt 46 irrespective of forward rotation and backward rotation of the driving pulley 43. Moreover, since the rotating members 53 and 54 are provided at the lower end side more than the rotational center O of the driving pulley 43 and at both outsides in the outer diameter direction more than the outer circumferential face of the timing belt 46 windingly stretched on the driving pulley 43, there is no need to severely set a positional relationship between the driving pulley 43 and the belt tooth skipping preventing member and it is possible to reliably prevent the belt tooth skipping between the driving pulley 43 and the timing belt 46.

In accordance with the present disclosure, as described above, by a small number of components and a simple configuration, it is possible to prevent belt coming-off and the belt tooth skipping between the driving pulley 43 and the timing belt 46. Moreover, since the rotating members 53 and 54 are provided as the belt tooth skipping preventing members, even if tension of the timing belt 46 is set to be lower than normal, it is possible to regularly elevate the stacking tray 38 can by the tray elevating mechanism 37. In this manner, it is possible to reduce a load on the driving part 48 of the tray elevating mechanism 37 and, in some cases, to make management of the tension of the timing belt 46 unnecessary.

In addition, in the embodiment, the rotating members 53 and 54 are respectively attached at positions coming close to or coming into contact with the outer circumferential face of the timing belt 46 windingly stretched on the driving pulley 43. In this manner, it is possible to more reliably prevent the belt tooth skipping between the driving pulley 43 and the timing belt 46.

In addition, in the embodiment, the post-processing device 30 as the sheet housing device further includes a holding member 50 attached to idle with respect to the coupling shaft 44 (the rotating shaft of the driving pulley 43) and covering the driving pulley 43 from the outside in the axial direction and the rotating members 53 and 54 are attached to the holding member 50. In this manner, in the post-processing device 30, by a simple configuration provided with the above-described holding member 50 as a belt coming-off preventing member, it is possible to prevent the belt coming-off (dropping-off) from the driving pulley 43 of the timing belt 46. Moreover, by a simple configuration attaching the rotating members 53 and 54 to the holding member 50, it is possible to actualize the belt tooth skipping preventing member.

Figure 8:
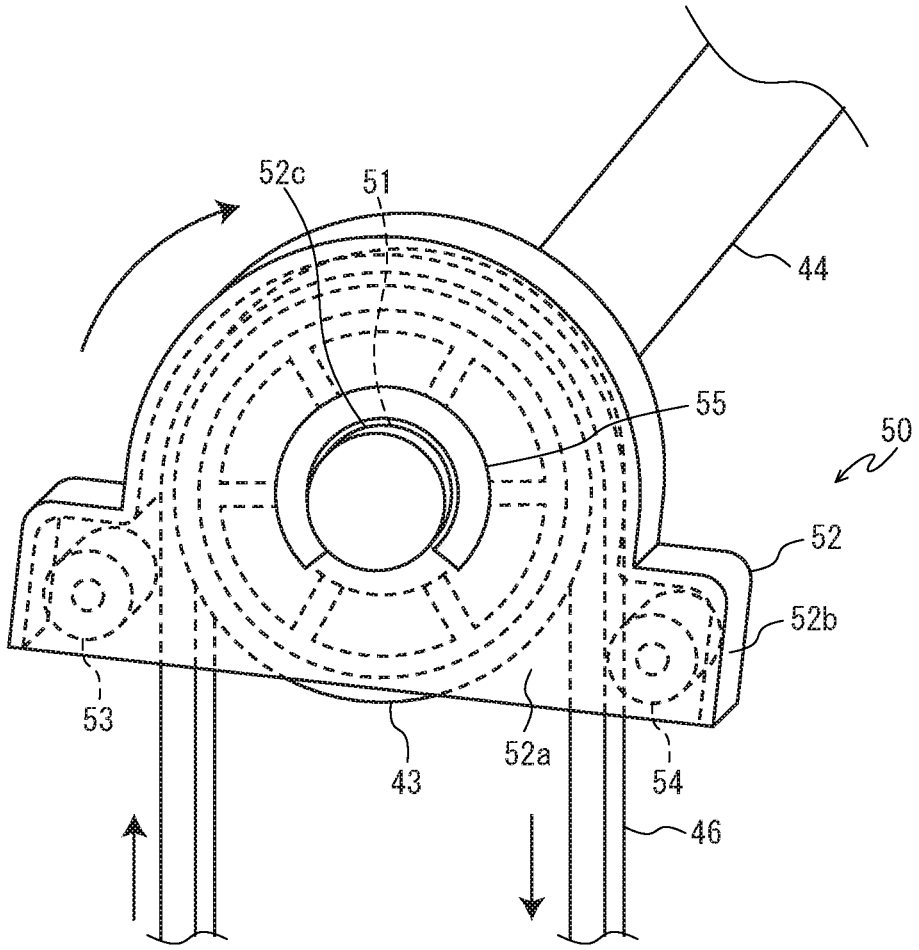
FIG. 8 is a perspective view showing the upper part of the tray elevating mechanism, in a case where the holding member has been biased, in the post-processing device according to the embodiment of the present disclosure.
Figure 9:
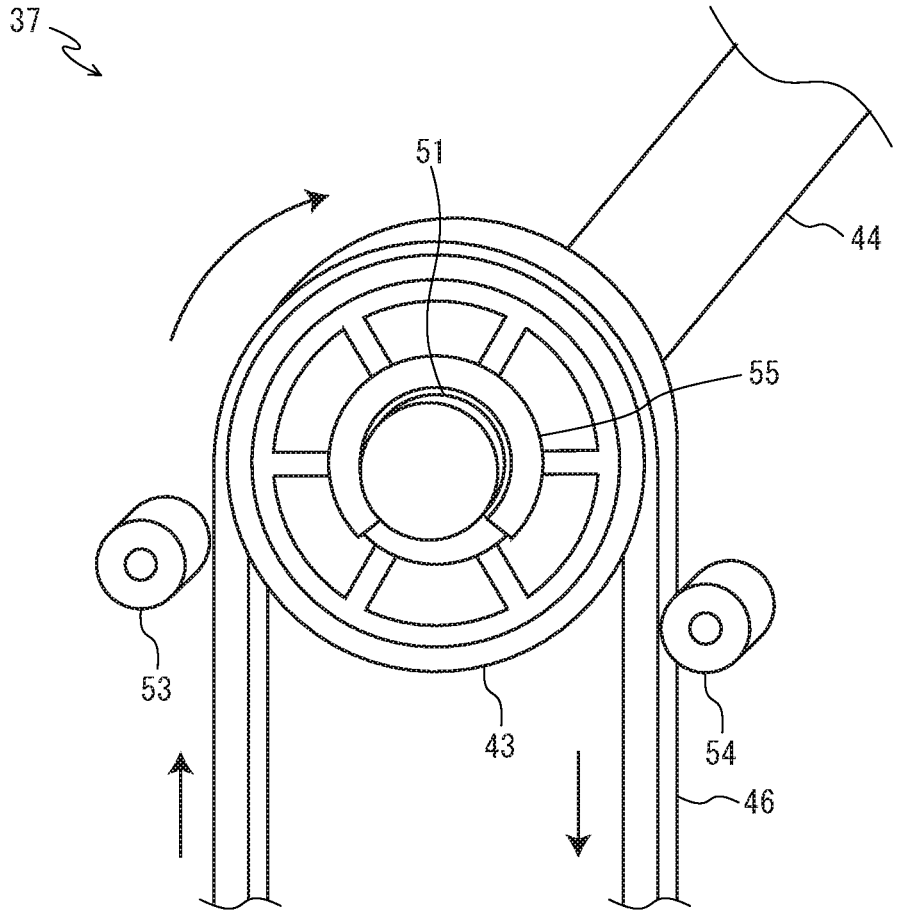
FIG. 9 is a perspective view showing the upper part of the tray elevating mechanism, in a state that the covering part has been detached in the case where the holding member has been biased, in the post-processing device according to the embodiment of the present disclosure.

Further, according to another embodiment, in the post-processing device 30 as the sheet housing device, the tray elevating mechanism 37 may be configured so that, when the driving pulley 43 is driven and rotated, as shown in FIG. 8 and FIG. 9, the holding member 50 is biased in a rotational direction of the driving pulley 43. Since the holding member 50 is adapted to idle with the coupling shaft 44 (the rotating shaft of the driving pulley 43), if the holding member 50 is biased in the rotational direction of the driving pulley 43, among the two rotating members 53 and 54, either one rotating member positioned at a downstream side in the rotational direction more than the driving pulley 43 is pressed against the outer circumferential face of the timing belt 46. Furthermore, among the two rotating members 53 and 54, another rotating member positioned at the upstream side in the rotational direction more than the driving pulley 43 is separated from the outer circumferential face of the timing belt 46.

For example, when the stacking tray 38 is risen, if the driving pulley 43 is rotated in the clockwise direction as viewed from the front side, tension occurs at a left side portion of the timing belt 46 wound up by the driving pulley 43 and slackness occurs at a right side portion of the timing belt 46 sent out from the driving pulley 43. In other words, the left side portion of the timing belt 46 positioned at the upstream side in the rotational direction more than the driving pulley 43 is a tensioned side and the right side portion of the timing belt 46 positioned at the downstream side in the rotational direction more than the driving pulley 43 is a slackened side.

In addition, the holding member 50 biased in the rotational direction of the driving pulley 43 is inclined in a left upward direction (a right downward direction) around the coupling shaft 44. Since the two rotating members 53 and 54 are lower than the coupling shaft 44, the rotating member 53 at the left side (at the upstream side in the rotational direction) is separated from the outer circumferential face of the timing belt 46 and the rotating member 54 at the right side (at the downstream side in the rotational direction) is pressed against the outer circumferential face of the timing belt 46.

When the timing belt 46 windingly stretched on the driving pulley 43 is slackened, the belt coming-off and the belt tooth skipping may be prone to occur. However, according to the embodiment, as described above, since the rotating member 54 at the slackened side (at the downstream side in the rotational direction) is pressed against the outer circumferential face of the timing belt 46, it is possible to more reliably prevent the belt coming-off and the belt tooth skipping of the timing belt 46.

In the tray elevating mechanism 37, in order to bias the holding member 50 in the rotational direction of the driving pulley 43, for example, a biasing member (not shown), such as a spring, may be attached to the holding member 50. For example, a biasing supporting part (not shown) being movable in the left and right directions (an orthogonal direction to the longitudinal direction of the supporting member) is provided above the holding member 50 (at one end side in the forward and backward directions of the supporting member) and two biasing members respectively extending from the biasing supporting part to left and right ends of the holding member 50 are attached. Subsequently, in a case where the biasing supporting part is moved in the right direction, the biasing member at the left side biases the left end of the holding member 50 upwardly. On the other hand, in a case where the biasing supporting part is moved in the left direction, the biasing member at the right side biases the right end of the holding member 50 upwardly.

Alternatively, the tray elevating mechanism 37 may be configured, in order to bias the holding member 50 in the rotational direction of the driving pulley 43, so that the inside face in the axial direction (the interior face) of the wall portion 52*a* of the covering part 52 of the holding member 50 is brought into slight contact (sliding contact) with the outside face in the axial direction of the driving pulley 43. In this manner, according to rotation of the driving pulley 43, the holding member 50 is slightly slid and receives a biasing force in the rotational direction. Thereby, it is possible to bias the holding member 50 in the rotational direction of the driving pulley 43 by a simple configuration.

Although the embodiment was described as to the configuration of applying the sheet housing device of the present disclosure to the post-processing device 30 as a so called in-body finisher attached to the in-body space 4 of the apparatus main body 2 of the multifunction peripheral 1, the present disclosure is not limitative thereto. For example, in another embodiment, the sheet housing device of the present disclosure may be applied to a post-processing device attached to a side face of the apparatus main body 2 or a post-processing device of another configuration, or alternatively, is directly provided in the apparatus main body 2.

The embodiment was described in a case of applying the configuration of the present disclosure to the post-processing device 30 connected to the multifunction peripheral 1. On the other hand, in another embodiment, the configuration of the disclosure may be applied to the post-processing device 30 connected to another image forming apparatus, such as a printer, a copying machine or a facsimile.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

What is claimed is:

1. A sheet housing device comprising:

a supporting member;

a driving pulley rotatably provided at an upper end side in the supporting member;

a driven pulley rotatably provided at a lower end side in the supporting member;

a timing belt windingly stretched between the driving pulley and the driven pulley;

a driving part driving and rotating the driving pulley;

a stacking tray fixed to the timing belt and attached to the supporting member so as to move between the upper end side and the lower end side of the supporting member in accordance with rotation of the timing belt;

rotating members provided at the lower end side more than a rotating shaft of the driving pulley and at both outsides in an outer diameter direction more than an outer circumferential face of the timing belt windingly stretched on the driving pulley, and rotatably attached by having rotating shafts parallel to the rotating shaft of the driving pulley; and a holding member attached to idle with respect to the rotating shaft of the driving pulley and covering the driving pulley from an outside in an axial direction, wherein the rotating members are attached to the holding member.

2. The sheet housing device according to claim 1, wherein the rotating members are attached to a position coming close to or coming into contact with the outer circumferential face of the timing belt windingly stretched on the driving pulley.

3. An image forming apparatus comprising:

the sheet housing device according to claim 2; and an image forming part forming an image on a sheet.

4. The sheet housing device according to claim 1, wherein an inside face of the holding member is provided to be slightly brought into sliding contact with an outside face of the driving pulley, the holding member is slightly slid by sliding contact with the driving pulley and biased in a rotational direction of the driving pulley by being slid when the driving pulley is driven and rotated, and by the biasing, one of the rotating members positioned at a downstream side more than the driving pulley is pressed against the outer circumferential face of the timing belt and another of the rotating members positioned at an upstream side in the rotational direction more than the driving pulley is separated from the outer circumferential face of the timing belt.

5. An image forming apparatus comprising:

the sheet housing device according to claim 4; and an image forming part forming an image on a sheet.

6. The sheet housing device according to claim 1, further comprising:

a post-processing part carrying out post-processes with respect to a sheet on which an image is formed; and a conveying outlet provided at a downstream side of a conveying path arranged for conveying the sheet to be post-processed, wherein the stacking tray is extended from the conveying outlet.

7. An image forming apparatus comprising:

the sheet housing device according to claim 6; and an image forming part forming an image on a sheet.

8. An image forming apparatus comprising:

the sheet housing device according to claim 1; and an image forming part forming an image on a sheet.

* * * * *